US005394708A

United States Patent [19]

Whinery et al.

[11] Patent Number: 5,394,708

[45] Date of Patent: Mar. 7, 1995

[54] AUGER-TYPE ICE MAKING APPARATUS

[75] Inventors: John Whinery, Allentown; Joseph T. Piatnik, Tannersville, both of Pa.

[73] Assignee: Follett Corporation, Pa.

[21] Appl. No.: 145,778

[22] Filed: Oct. 29, 1993

[51] Int. Cl.[6] ..... F25C 1/14

[52] U.S. Cl. ..... 62/354; 165/94

[58] Field of Search ..... 62/354; 165/94

[56] References Cited

U.S. PATENT DOCUMENTS

| | | | |
|---|---|---|---|
| 3,126,719 | 3/1964 | Swatsick | 62/354 X |
| 3,371,505 | 3/1968 | Raver et al. | 62/320 |
| 3,913,343 | 10/1975 | Rowland et al. | 62/137 |
| 3,937,365 | 2/1976 | Shelley et al. | 222/241 |
| 4,429,551 | 2/1984 | Hizume | 62/354 |
| 4,497,184 | 2/1985 | Utter et al. | 62/354 |
| 4,533,310 | 8/1985 | Spinner | 425/376 |
| 4,732,301 | 3/1988 | Tobias et al. | 222/203 |
| 4,760,710 | 8/1988 | Takagi | 62/354 |
| 4,817,827 | 4/1989 | Kito et al. | 222/238 |
| 4,932,223 | 6/1990 | Paul et al. | 62/354 |
| 4,942,983 | 7/1990 | Bradbury | 222/238 |
| 4,991,407 | 2/1991 | Alvarez et al. | 62/354 |

*Primary Examiner*—William E. Tapolcai
*Attorney, Agent, or Firm*—Paul & Paul

[57] ABSTRACT

The present invention provides an apparatus for an auger-type ice maker comprising a generally cylindrically-shaped freezing chamber, a rotatable ice auger within the freezing chamber, and an annular compacting head at an end of the freezing cheer whereby ice formed in the freezing chamber is transferred by means of rotation of the ice auger into a region above the auger where it is compacted. The inner surface of the cylindrical freezing chamber is provided with a plurality of axial grooves to guide the column of ice created by the auger and to oppose rotation of the column of ice induced by the rotation of the ice auger, and the top surface of the auger, adjacent to the compacting head, has a knurled surface to aid in the discharge of ice. The combination of the axial grooves and the knurled auger surface creates a denser, higher quality product of ice than prior inventions.

8 Claims, 3 Drawing Sheets

AUGER-TYPE ICE MAKING APPARATUS

BACKGROUND OF THE INVENTION

This invention relates to auger-type ice making machines used in a commercial setting, which produce flaked or chipped ice. Ice is formed by water freezing on the inner wall of a hollow cylindrical freezing chamber. A rotatable ice auger, sized to enable the scraping of ice off the inner surface of the freezing cheer, conveys the flaked ice toward the axial end of the freezing chamber whereby the flaked ice is compressed into a rigid mass of ice which is subsequently severed into discrete, generally uniform chunks of ice.

The present invention is directed toward a new and improved auger-type ice making machine which produces higher quality, denser flaked ice as compared to prior art equipment. Through the combined use of a plurality of axial grooves on the inner wall of the ice forming chamber and a knurling pattern on the top surface of the auger, denser, more uniform and clearer ice is produced.

SUMMARY OF THE INVENTION

This invention relates to an auger-type ice making apparatus of the type wherein ice is produced on the inner walls of a cylindrical freezing chamber. A rotatable ice auger scrapes such walls producing flaked ice. The inner walls of the freezing chamber contain a plurality of longitudinal, axial grooves, spaced at generally equal intervals. The grooves aid in guiding the ice toward an annular compacting head which is oriented generally normal to the axis of rotation of the auger shaft, while concurrently aiding the compressing and consolidating of the flakes of ice. The upper surface of the auger has a knurled, annular surface, formed to grip the compacted ice, whereby flow of ice out of the freezing chamber is improved. The combined effect of the axial grooves and the knurled auger surface first counters the rotation of the column of ice in the freezing chamber caused by the rotation of the auger, then enables the rotation of the knurled auger surface to drive the ice from the chamber, thereby producing more compact, denser, higher quality ice. The compacted ice being discharged from the freezing chamber passes through a narrowing chamber, is severed into discrete, generally uniform chunks and is delivered to an outlet delivery line.

This invention relates generally to an auger-type ice making apparatus where flaked ice is created on the interior wall of a cylindrical freezing chamber, scraped off the wall by an ice auger, and transferred out of the chamber, through a discharge aperture, to a discharge line.

It is accordingly a general object of the present invention to provide a new and improved auger-type ice making apparatus.

It is another object of the present invention to provide a new and improved auger-type ice making apparatus which comprises a combination of a means for first gripping the ice in the freezing chamber to counter rotational movement induced by the rotating auger, and a means for facilitating a rotational gripping at an end thereof for discharge from the chamber.

Other objects and advantages of the present invention will become apparent form the following description taken in conjunction with the accompanying drawings.

DESCRIPTION OF THE PREFERRED EMBODIMENT

Figure 1:
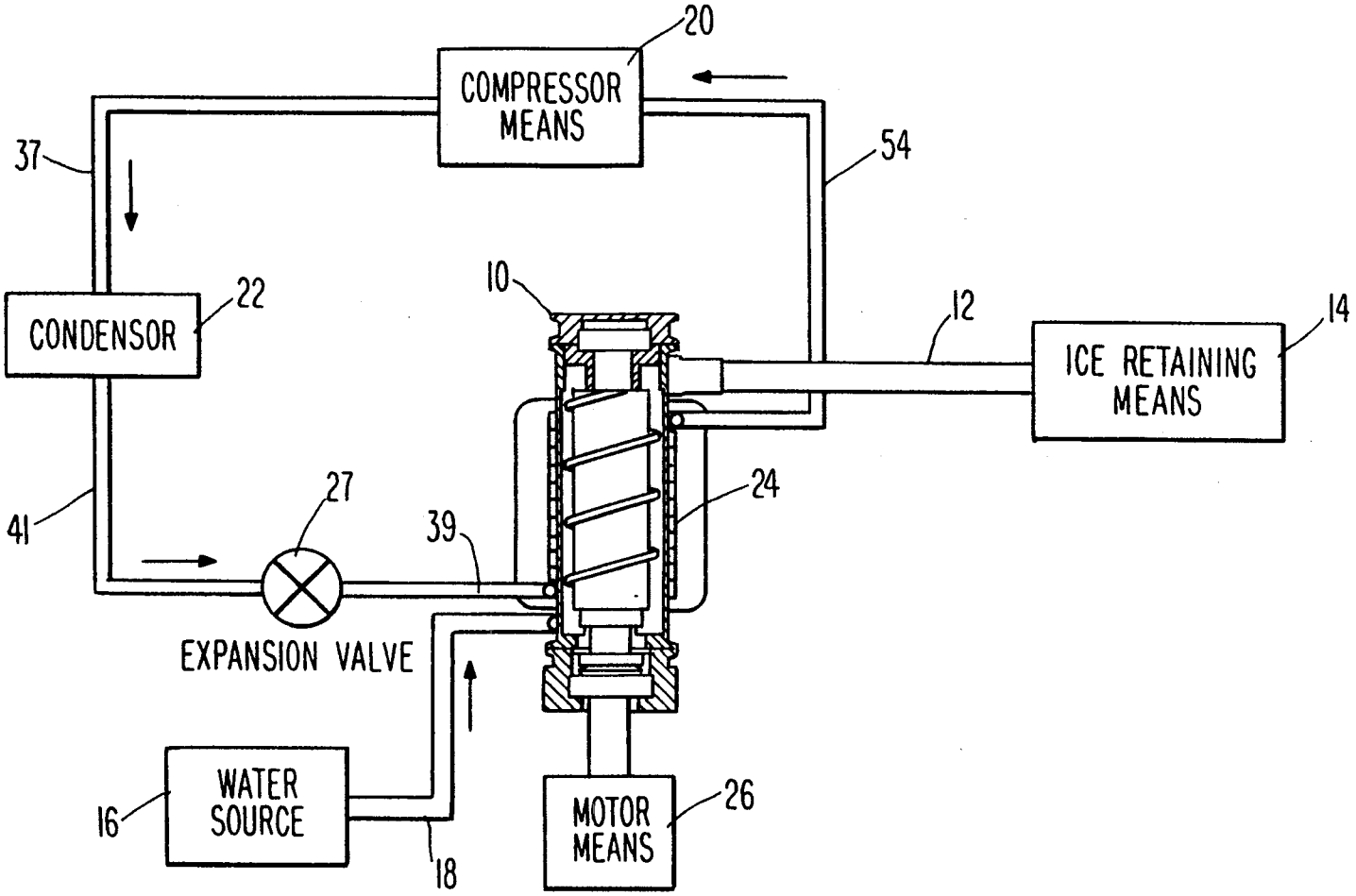
FIG. 1 is a schematic diagram of the ice making apparatus according to the present invention.
Figure 2:
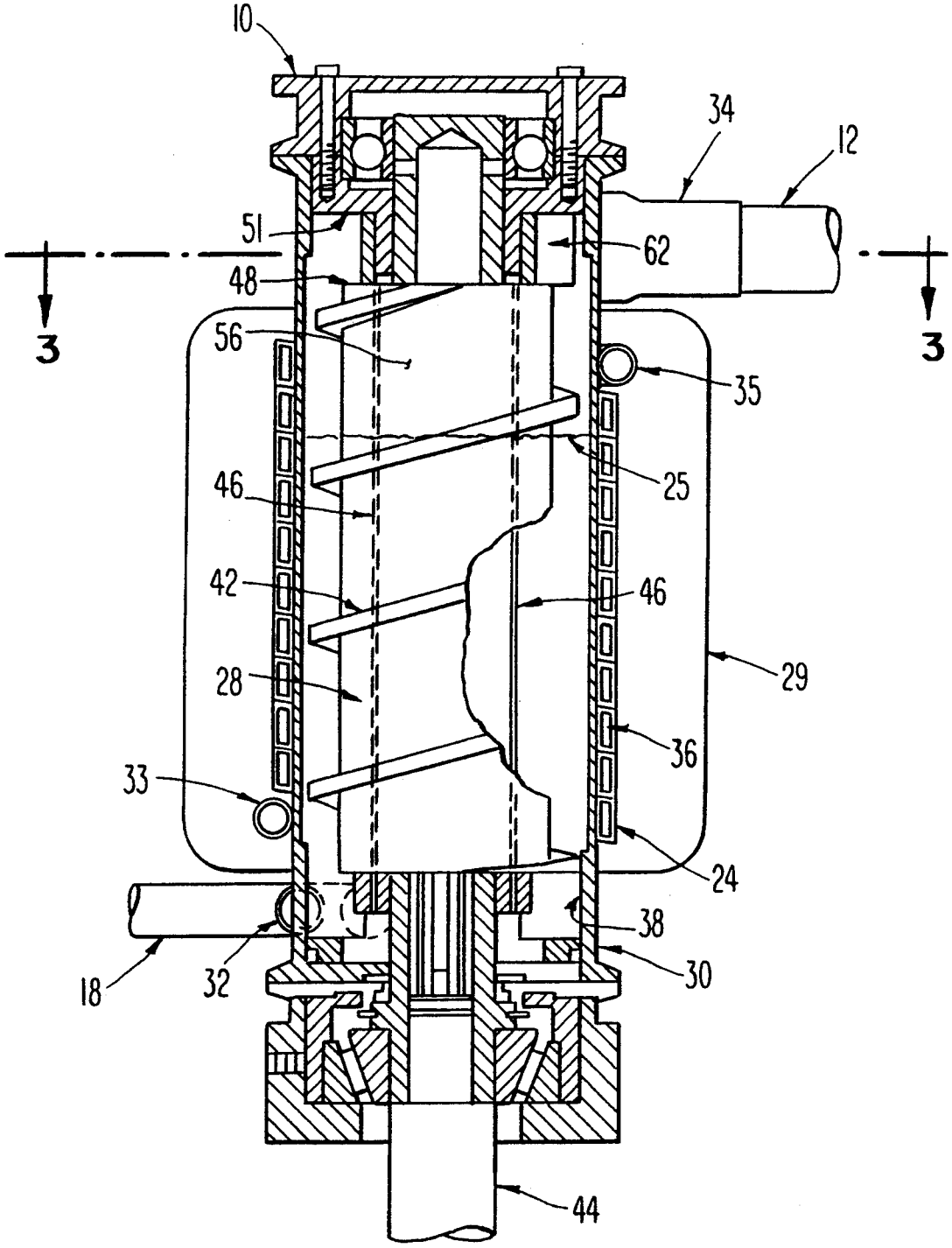
FIG. 2 is an elevational view, partially broken away of the auger-type ice generating apparatus embodied in the system shown in FIG. 1, generally along line 2—2 of FIG. 3.

Referring now in detail to the drawings, wherein like reference numerals indicate like elements throughout the several views, there is shown in FIGS. 1 and 2 an ice making apparatus in accordance with one preferred embodiment of the present invention. The illustrative apparatus is shown generally comprising an auger-type ice generating apparatus 10, with a motor means 26 to drive the ice generating apparatus 10, an input line for water 18 from a water source 16 to be frozen, an outlet delivery line 12 for delivery of chunks of ice to an ice retaining means 14, a refrigeration means comprising a compressor means 20, a condenser means 22, an expansion valve 27, and evaporator 24 to supply refrigeration to the ice generating means 10.

In operation of the ice maker according to the present invention, conventional refrigerant under pressure is sent from the compressor means 20 via line 37 to the condenser means 22. The refrigerant is thereafter liquefied within the condenser means 22 and then passed through an expansion valve 27 to the evaporator 24. Evaporator 24, which completely surrounds the ice making machine 10, boils the liquid refrigerant under low pressure to extract heat from, and accordingly cool, the generally cylindrical ice freezing chamber 30. Evaporator 24 additionally comprises an evaporator cover 29 which serves as an insulator and protective cover. Water is supplied to the cylindrical freezing chamber 30, which houses an ice auger 28, from a water source 16 through water input line 18. A constant level of water 25 is maintained in the freezing chamber. Water freezes on the inner wall 38 of the freezing chamber 30 and is scraped off by means of the ice auger 28.

The ice generating apparatus 10 according to the present invention is shown in greater detail in FIG. 2. The auger 28 is disposed vertically in the interior of the freezing chamber 30 and is driven by drive shaft 44. Actuation of the motor means 26 results in a rotation of the auger 28 which causes ice to be scraped off the inner wall 38 of the freezing chamber 30 in flaked form. The ice generating apparatus 10 includes a water inlet 32, formed on its lower end for receiving water from the inlet line 18, and an ice discharge 34, formed on the upper end for delivering generated ice to the delivery line 12. Tubing 36 is also included, wrapped a plurality of times around the freezing chamber 30 which defines the aforementioned evaporator 24. Evaporator 24 includes an inlet 33 for receiving the refrigerant from the expansion valve 27, and refrigerant vapor is passed out through an outlet 35, into outlet line 54 where, as shown in FIG. 1, it is carried back to the compressor means 20. The refrigerant extracts heat from the ice generating apparatus 10 through the walls of freezing chamber 30 as it is passed through the evaporator 24. This causes some of the water contained within the freezing chamber 30 to freeze along the inner wall 38.

Auger 28 includes at least one coiled band of scrapers 42 extending outward from the auger surface 56, in close proximity to the inner wall 38 of the freezing chamber 30. A drive shaft 44 connects to the motor means 26 extending axially through the auger 28. Accordingly, as auger 28 is rotated, the scraper 42 shaves the ice formed on inside walls 38, carrying it axially upward, in the form of slush, to be compacted against an annular compacting head 51.

The axial grooves 46, preferably 6 in number, guide the column of ice and reduce rotation of the column of ice created in the ice generating apparatus 10 by the rotation of the auger 28. The upper surface of the auger 28 has a knurled annular surface 48, like the radial groove knurling shown in FIG. 3 or like the alternate knurling 48' shown in FIG. 4, or in any other manner such as hatching or the like (not shown). The knurled annular surface 48, whichever form it may take, is disposed spaced below the annular compacting head 51 and grips the ice to guide the ice through ice discharge 34 where the ice is severed into discrete chunks of ice. The resistance to rotation caused by the rifling or axial grooves 46 allows for higher compressive forces on the ice, and in combination with the knurled annular surface 48, 48' on the upper surface of the auger 28 aids in the discharge of compressed ice of higher quality which is denser, clearer, and more uniform. A substantial reduction in the amount of excess water, trapped air and impurities is gained compared to prior apparatuses.

Figure 3:
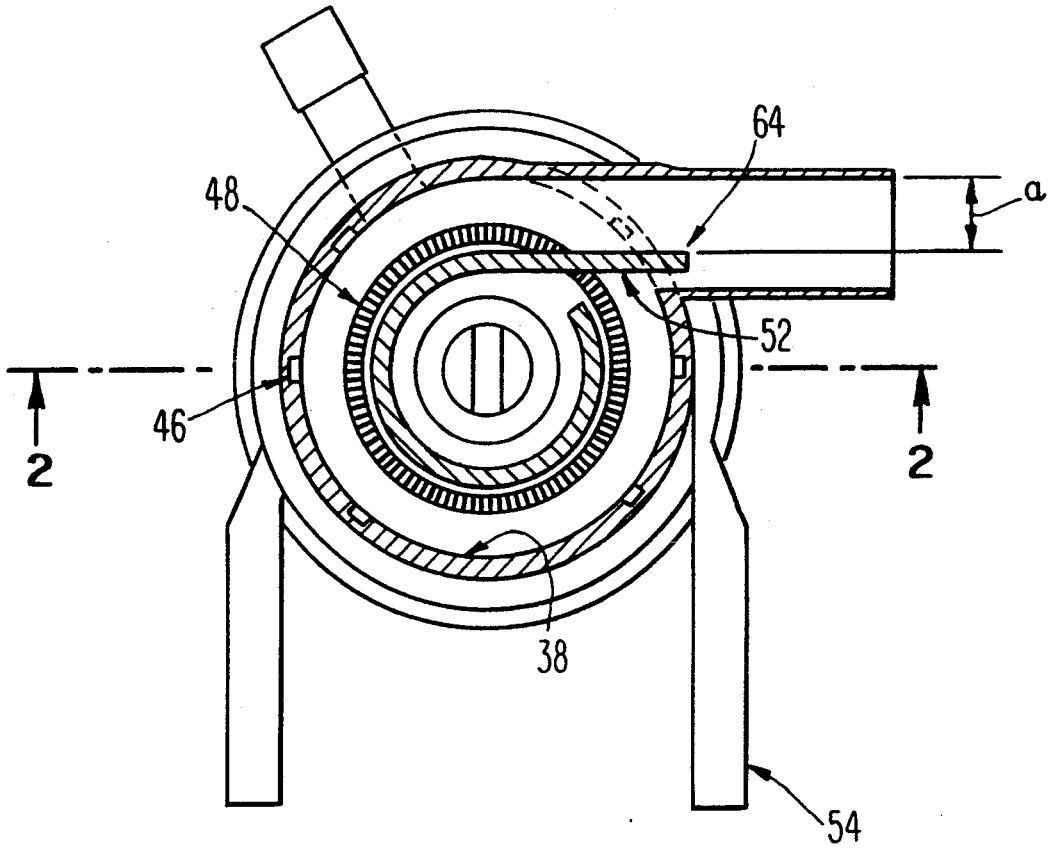
FIG. 3 is a longitudinal cross sectional view of FIG. 2 taken substantially along line 3—3 of FIG. 2 with the evaporator cover not shown.
Figure 4:
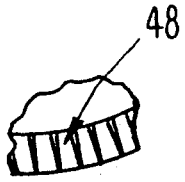
FIG. 4 is a fragmentary view of the end of an auger alternative to that of FIG. 3, wherein an alternative knurling configuration is illustrated.

As best seen in the sectional plan view of FIG. 3, as the auger 28 continues to rotate, the ice passes through a narrowing passage, defined by the distance "a" between inner wall 38 and outer wall of guide member 62, which further compacts the ice and removes excess water. This continuous column of ice generated through the narrowing passage is thereafter passed over an end section 64 of guide member 62, which severs the ice into substantially uniform pieces that are discharged out through ice discharge 34. As indicated above, the ice discharged through the discharge 34 is sent via line 12 to the retaining means 14.

As previously described, the important features of the present invention are to better control the flow of ice particles as they pass through the freezing chamber 30 and are compressed in order to get a denser, clearer, more uniform ice product. In the preferred embodiment of the present invention, the cylindrical freezing chamber 30 has a plurality of longitudinal or axial grooves 46 spaced at generally equal intervals around the inner circumference of the chamber 30. Additionally, the preferred embodiment of the present invention has a knurled annular surface 48, 48' on the top of the ice auger 28 spaced from the annular compacting head. The combination of the axial grooves 46 and the knurled annular surface 48 create a superior quality of ice.

It will be recognized by those skilled in the art that changes may be made in the above described embodiments of the invention without departing from the broad inventive concepts thereof. It is understood, therefore, that this invention is not limited to the particular embodiments disclosed, but is intended to cover all modifications which are within the scope and spirit of the invention as defined by the appended claims.

What is claimed is:

1. An ice making apparatus comprising:

a generally cylindrical and hollow freezing chamber;

an annular compacting head at an end of said freezing chamber normal to the axis of said freezing chamber;

a rotatable ice auger sized to fit into said freezing chamber whereby said auger scrapes ice formed on the walls of said chamber and conveys said ice toward a discharge end of said auger and said annular compacting head;

a means on the inner cylinder wall of said freezing chamber for facilitating axial movement of the ice whereby resistance to rotational movement of the ice relative to the chamber wall is created;

a gripping means on said discharge end of said ice auger on a surface adjacent to said annular compacting head to improve gripping of said ice, wherein said gripping means on the ice auger is an abrasive surface, whereby discharge flow of the ice compacted by said annular compacting head is improved;

a means to cause rotation of said ice auger;

a means to discharge ice from said freezing chamber;

a means for supplying water to said freezing chamber; and a refrigeration means for cooling said freezing chamber.

2. An ice making apparatus comprising:

a generally cylindrical and hollow freezing chamber:

an annular compacting head at an end of said freezing chamber normal to the axis of said freezing chamber;

a rotatable ice auger sized to fit into said freezing chamber whereby said auger scrapes ice formed on the walls of said chamber and conveys said ice toward a discharge end of said auger and said annular compacting head;

a means on the inner cylinder wall of said freezing chamber for facilitating axial movement of the ice whereby resistance to rotational movement of the ice relative to the chamber wall is created;

a gripping means on said discharge end of said ice auger on a surface adjacent to said annular compacting head to improve gripping of said ice, wherein said gripping means on the ice auger is a knurl pattern, whereby discharge flow of the ice compacted by said annular compacting head is improved;

a means to cause rotation of said ice auger;

a means to discharge ice from said freezing chamber;

a means for supplying water to said freezing chamber; and a refrigeration means for cooling said freezing chamber.

3. An ice making apparatus comprising:

a generally cylindrical and hollow freezing chamber;

an annular compacting head at an end of said freezing chamber normal to the axis of said freezing chamber;

a rotatable ice auger sized to fit into said freezing chamber whereby said auger scrapes ice formed on the walls of said chamber and conveys said ice toward a discharge end of said auger and said annular compacting head;

a means on the inner cylinder wall of said freezing chamber for facilitating axial movement of the ice whereby resistance to rotational movement of the ice relative to the chamber wall is created;

a gripping means on said discharge end of said ice auger on a surface adjacent to said annular compacting head to improve gripping of said ice, wherein said gripping means on the ice auger is inscribed radial lines, whereby discharge flow of the ice compacted by said annular compacting head is improved;

a means to cause rotation of said ice auger;

a means to discharge ice from said freezing chamber;

a means for supplying water to said freezing chamber; and a refrigeration means for cooling said freezing chamber.

4. An ice making apparatus comprising:

a generally cylindrical and hollow freezing chamber:

an annular compacting head at an end of said freezing chamber normal to the axis of said freezing chamber;

a rotatable ice auger sized to fit into said freezing chamber whereby said auger scraper ice formed on the walls of said chamber and conveys said ice toward a discharge end of said auger and said annular compacting head;

a means on the inner cylinder wall of said freezing chamber for facilitating axial movement of the ice, wherein said means comprises a plurality of axial grooves extending longitudinally in said freezing chamber and protruding generally radially outwardly from the inner surface of said freezing chamber, whereby, resistance to rotational movement of the ice relative to the chamber wall is created;

a gripping means on said discharge end of said ice auger on a surface adjacent to said annular compacting head to improve gripping of said ice, wherein said gripping means on the ice auger is a knurl pattern with an abrasive surface whereby discharge flow of the ice compacted by said annular compacting head is improved;

a means to cause rotation of said ice auger;

a means to discharge ice from said freezing chamber;

a means for supplying water to said freezing chamber; and a refrigeration means for cooling said freezing chamber.

5. The apparatus as set forth in any of claims 1–4, wherein said means for facilitating axial movement comprises a plurality of axial grooves extending longitudinally in said freezing chamber and protruding generally radially outwardly from the inner surface of said freezing chamber.

6. The apparatus as set forth in claim 5, wherein said axial grooves occur at approximately sixty degree intervals on the inner circumference of said freezing chamber.

7. The apparatus as set forth in any of claims 1–4, wherein said means for facilitating axial movement comprises a plurality of axial ribs extending longitudinally on the inner surface of said freezing chamber and protruding generally radially inwardly from the inner surface of said freezing chamber.

8. The apparatus as set forth in any of claims 1–4, wherein said means for facilitating axial movement comprises a plurality of axial grooves and a plurality of axial ribs extending longitudinally on the inner surface of said freezing chamber.

* * * * *

UNITED STATES PATENT AND TRADEMARK OFFICE

CERTIFICATE OF CORRECTION

PATENT NO. : 5,394,708

DATED : March 7, 1995

INVENTOR(S) : John S. Whinery et al.

It is certified that error appears in the above-indentified patent and that said Letters Patent is hereby corrected as shown below:

In the Abstract, line 5, "cheer" should be -- chamber --;

Col. 1, line 11, "cheer" should be -- chamber --; and

Col. 5, line 20, "scraper" should be -- scrapes --.

Signed and Sealed this

Fourth Day of July, 1995

Bruce Lehman

*Attest:*

BRUCE LEHMAN

*Attesting Officer*

*Commissioner of Patents and Trademarks*